US006237289B1

(12) United States Patent
Jewett et al.

(10) Patent No.: US 6,237,289 B1
(45) Date of Patent: May 29, 2001

(54) GROUND ANCHOR

(75) Inventors: Thomas E. Jewett, Morrison; John Yapundich, Denver, both of CO (US)

(73) Assignee: Foresight Products, Inc., Commerce City, CO (US)

( * ) Notice: Subject to any disclaimer, the term of this patent is extended or adjusted under 35 U.S.C. 154(b) by 559 days.

(21) Appl. No.: 08/586,966

(22) Filed: Jan. 16, 1996

(51) Int. Cl.[7] ..... E02D 5/80

(52) U.S. Cl. ..... 52/163; 52/155; 52/156; 52/166; 405/259.1; 405/259.5

(58) Field of Search ..... 52/155, 156, 162, 52/163, 164, 165, 166; 405/253, 254, 259.1, 259.4, 259.5

(56) References Cited

U.S. PATENT DOCUMENTS

| | | | | |
|---|---|---|---|---|
| 994,356 | * | 6/1911 | Wood | 52/163 |
| 2,841,256 | * | 7/1958 | Clevett, Jr. | 52/166 X |
| 3,494,134 | * | 2/1970 | Jorge | 52/166 X |
| 3,946,570 | * | 3/1976 | Freydier | 52/166 X |
| 4,044,513 | * | 8/1977 | Deike | 405/259.5 |
| 4,574,539 | * | 3/1986 | Deike | 52/166 X |
| 4,688,360 | * | 8/1987 | Luong et al. | 52/166 |
| 4,802,317 | * | 2/1989 | Chandler | 52/166 X |
| 5,026,213 | * | 6/1991 | Habib et al. | 52/162 X |
| 5,031,370 | * | 7/1991 | Jewett | 52/166 |

* cited by examiner

*Primary Examiner*—Michael Safavi
*Assistant Examiner*—Kevin D. Wilkens
(74) *Attorney, Agent, or Firm*—Hill & Simpson

(57) ABSTRACT

An improved wing-type ground anchor. The ground anchor includes a central body portion, wings radiating laterally from the body portion, and a leg portion at the front end of the body portion GROUND ANCHOR that operates like a star-point drill for penetrating the ground. The sides of the leg portion each include a plurality of sharpened leading side edges which are longitudinally offset from each other. Each of the wings also includes a plurality of sharpened leading side edges which are longitudinally offset with respect to each other. The offset leading side edges and wing edges progressively extend greater distances laterally outward from the body portion along the length of the leg portion and the wings. Since smaller side edges and wing edges are advanced first, the staged side and wing edges facilitate passage of the ground anchor through soil. The wings of the ground anchor also diminish in thickness and taper between the leading and trailing edges for reducing friction between the top and bottom wing surfaces and the soil. In combination, the staged side edges, staged wing edges, and tapered wings greatly reduce the driving force required to drive the ground anchor through the ground. The ground anchor also includes an elongated slot for connection to a pull member to reduce impact forces between the pull member and ground anchor by allowing them to move freely with respect to each other as they plow through the ground. The bottom of the ground anchor is also provided with first and second curved lip portions which project outwardly from the body portion for facilitating tilting of the ground anchor within the ground.

35 Claims, 5 Drawing Sheets

GROUND ANCHOR

BACKGROUND OF THE INVENTION

1. Field of the Invention

This invention relates to the art of plate or wing-type earth or ground anchors which are driven lengthwise into the ground and then pulled when reaching an optimum depth to tilt into a flat transverse position for anchoring guy rods, cables or the like.

2. Description of the Prior Art

Plate or wing-type ground anchors are well-known and an example of a particularly effective ground anchor is described in co-owned U.S. Pat. No. 4,802,317. Said ground anchor includes a tubular central body portion, a pair of wings radiating laterally from the body portion, and a cruciform star point at the front of the body portion which includes sharpened leading edges and operates like a star drill for penetrating the soil. The leading edges of the wings are also sharpened for facilitating penetration of the soil. A pull rod is connected to an eye portion of the ground anchor's body portion, and the trailing end of the ground anchor is sharpened and includes an extended curved lip for facilitating tilting of the anchor. In use, a drive rod is inserted into a socket in the tail end of the body portion, the drive rod is used to drive the ground anchor to an optimum depth within the ground, and the pull rod is then used to pull on the eye portion of the anchor so that the ground anchor tilts in the ground and assumes a position generally transverse to the hole in the ground.

While the U.S. Pat. No. 4,802,317 discloses a highly effective ground anchor, it is believed that it would be beneficial to further improve the device to facilitate its passage through the ground in order to conserve the driving energy required to place the ground anchor at its optimum depth within the ground.

It would also be an improvement in this art to provide means for balancing the profile of the ground anchor so that it follows a linear drive path in the ground even in the presence of de-stabilizing obstacles. It would also be an improvement to provide features which facilitate turning of the ground anchor in the ground. Features that reduce impact forces on the connection between the ground anchor and the pull member would also be a beneficial improvement.

SUMMARY OF THE INVENTION

An important aspect of this invention lies in providing a ground anchor which represents an improvement over the ground anchor disclosed in the U.S. Pat. No. 4,802,317 and which includes means for facilitating passage of the anchor through the ground. In the present invention, such objectives are achieved by providing the cruciform star point at the front of the ground anchor with multiple sharpened leading edges which are longitudinally offset with respect to each other. Generally, each of the sides of the cruciform star point includes a first forward leading edge and a second rearward leading edge, and the second or rearward edges projects laterally outward from the anchor body a greater distance than the first or forward leading edges. The offset or staged leading edges facilitate penetration of hard soil by advancing the smaller leading edges first which helps chip and crack hard soil layers and then facilitate passage of the rearward and larger leading edges.

The ground anchor also includes a pair of wings which radiate laterally from the body portion and the wings have leading and trailing edges. The leading edges of each of the wings are divided into a plurality of sharpened leading wing edges which are longitudinally offset with respect to each other. The wing edges are staggered and each wing edge successively extends a greater distance outward from the body portion. In use, each of the successive leading wing edges takes an increasingly larger bite out of the soil as the ground anchor is pushed through the ground. The smaller and foremost leading edges penetrate the ground easily and make it easier for the successive and larger wing edges to pass through the ground.

Another important aspect of this connection lies in providing the ground anchor with wings that diminish in thickness and taper between their leading and trailing edges to reduce friction between the wings and the ground. The leading edges of the wings are thicker than the remainder of the wings and plow through the ground to form a wide opening so that contact between the remainder of the wing surfaces and the ground is greatly reduced. Since contact and friction between the wing surfaces and the ground is greatly reduced, the driving energy required to push the ground anchor through the ground is also greatly reduced.

Another aspect of the invention lies in providing a secondary curved lip portion along the bottom of the ground anchor at its maximum profile. Generally, the secondary curved lip portion is positioned opposite from the connection between the pull member and the eye portion of the anchor so that the profile of the ground anchor is balanced which aids the anchor in maintaining a linear drive path as it ground anchor is driven through the ground. The second curved lip portion is small than and positioned forwardly of the first curved lip portion at the rear end of the ground anchor and facilitates penetration of hard soil by advancing the smaller curved lip portion first. Once the ground anchor is positioned at its optimum depth, the secondary curved lip portion also aids the first lip portion in digging into the ground and providing leverage for tilting the ground anchor within the soil.

The ground anchor of this invention is also provided with an elongated slot in the eye portion of the ground anchor. The elongated slot is sized to permit a pivot pin which secures the pull member to the ground anchor to longitudinally move with respect to the ground anchor. Accordingly, stresses on the connection between the ground anchor and the pull member are reduced since impact forces are dissipated by allowing the pull member to move freely with respect to the ground anchor as it plows through the ground.

Other objects, features and advantages of the present invention will also become apparent from the following description of the drawings.

DETAILED DESCRIPTION OF THE PREFERRED EMBODIMENT

Figure 1:
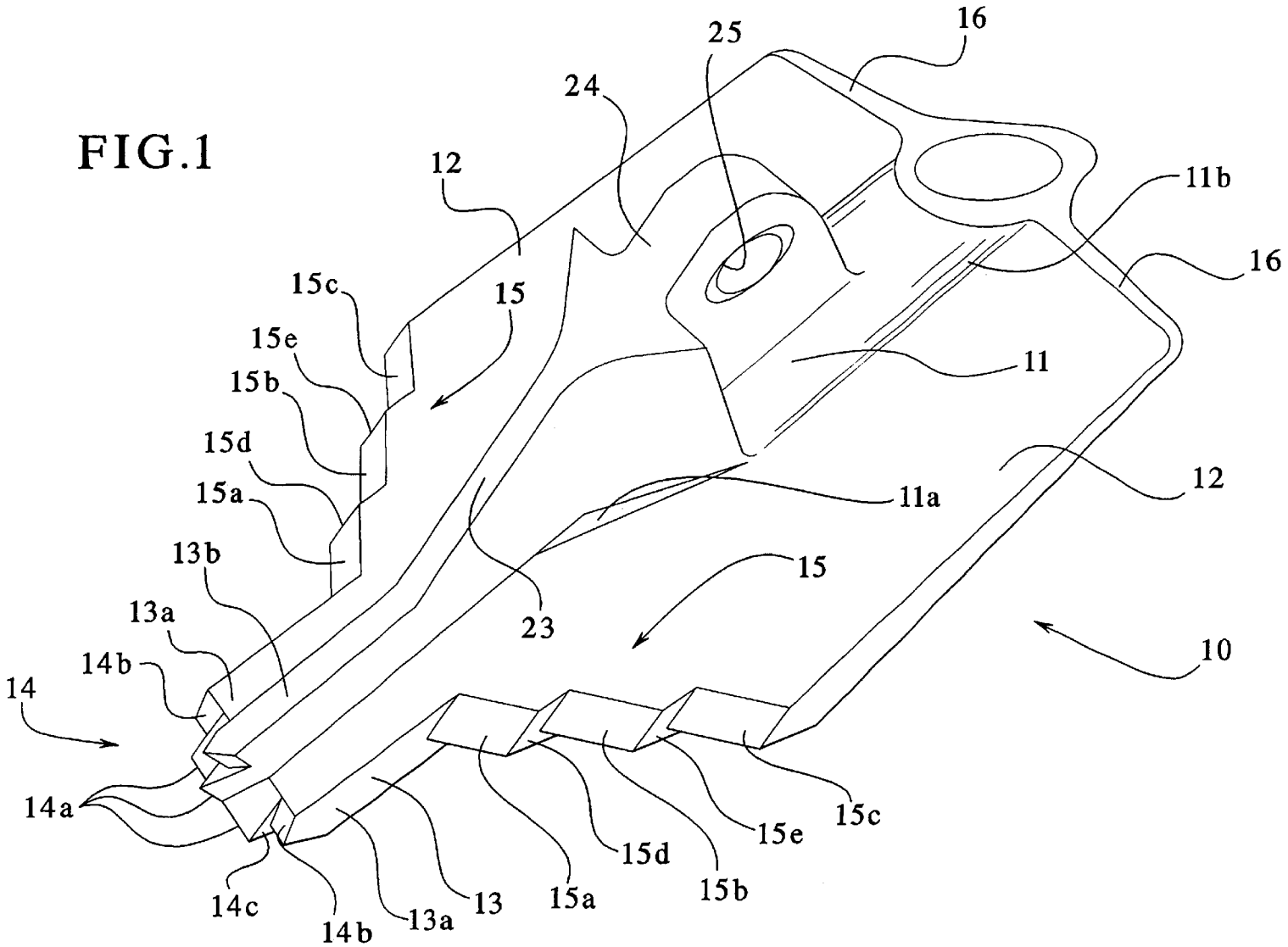
FIG. 1 is a top face and edge perspective view of a ground anchor embodying the present invention.

Referring to the drawings, the reference numeral 10 generally designates the ground anchor of this invention and the ground anchor 10 includes a central longitudinal tubular body 11 having front and back ends 11*a* and 11*b*. A pair of wings 12 radiate laterally from and extend along the length of the body portion 11. The front end 11*a* of the tubular body 11 includes a projecting cruciform, central axial-shaped leg portion 13 which operates like a star point drill for penetrating the ground.

The leg portion 13 includes a first pair of cruciform sides 13*a*, 13*a* which are in the same plane as the wings 12, 12 and are positioned forwardly on the leading edges of the wings. The other pair of sides 13*b*, 13*b* of the cruciform leg 13 are normal to the plane of the wings 12, 12 and merge into the forward end of the tubular body portion 11. To facilitate penetration of ground anchor 10 through soil, each of the sides 13*a*, 13*a* and 13*b*, 13*b* includes a plurality of sharpened leading side edges 14 which are longitudinally offset with respect to each other. In the embodiment shown in the drawings, each side of the cruciform leg 13 includes a first sharpened leading side edge 14*a* and a longitudinally offset second sharpened leading edge 14*b*. As shown, the leading side edges 14*a* and 14*b* extend generally perpendicular to the body portion 11 and are separated by an edge 14*c* which is parallel to the body portion 11. The second leading edges 14*b* are positioned rearwardly of the first leading edges 14*a* and extend laterally outward from leg portion 13 a greater distance than the first leading edges 14*a*. In use, the first leading edges 14*a* penetrate the soil first with greater ease due to their smaller size and help to chip and crack hard soil layers, as well as facilitating passage of the second and larger leading edges 14*b* by reducing the amount of soil that the larger leading edges must plow through. The first and second offset edges 14*a* and 14*b* allow leg portion 13 to pass through the soil easier than if the leg portion 13 were provided with only a single leading edge on each of the sides of the star point.

Figure 4:
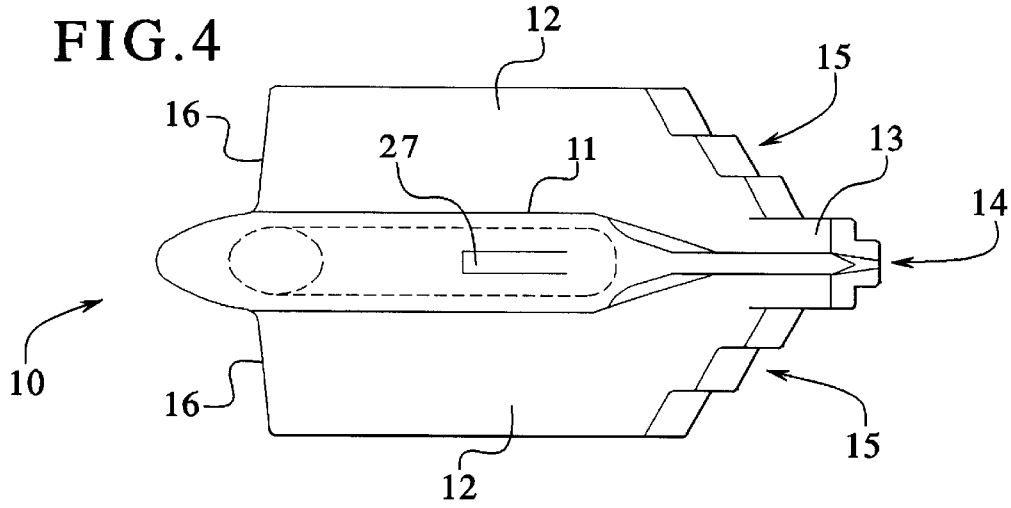
FIG. 4 is a bottom face view of the anchor of FIGS. 1–3.
Figure 5:
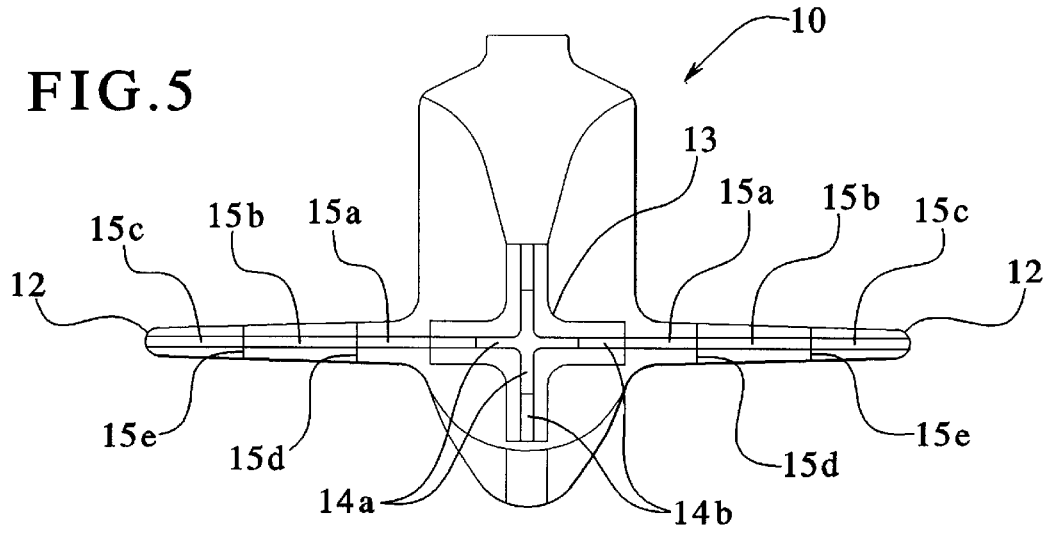
FIG. 5 is a leading edge elevational view of the anchor shown in FIGS. 1–4.
Figure 6:
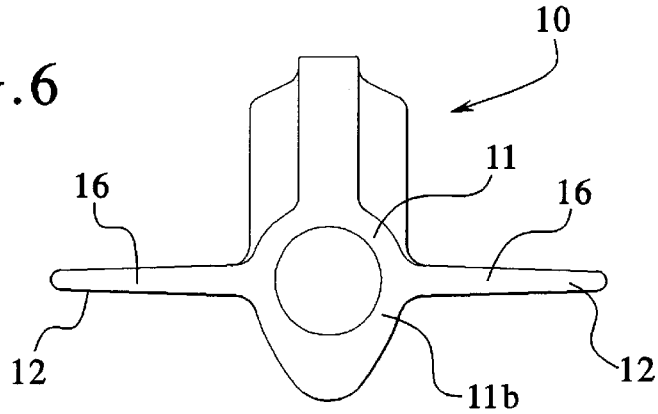
FIG. 6 is a trailing edge elevational view of the anchor shown in FIGS. 1–5.
Figure 10:
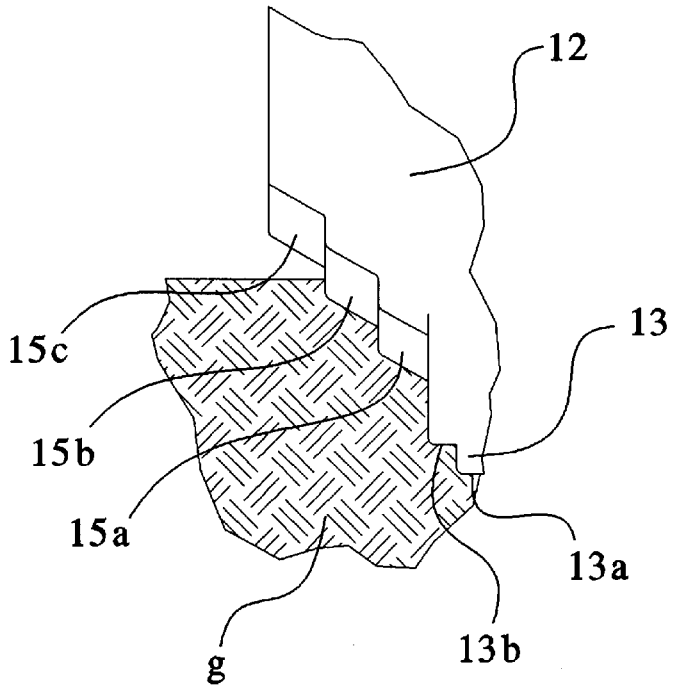
FIG. 10 is an enlarged front view of part of one of the wings of the ground anchor of this invention, illustrating the passage of that wing through the ground.

To further facilitate penetration of ground anchor 10 through the soil, each of the wings 12 include a plurality of sharpened leading wing edges 15 which are longitudinally offset with respect to each other. In the embodiment given in the illustrations, each leading edge 15 of the wings 12 includes first, second and third leading wing edges 15*a*, 15*b* and 15*c* which are respectively separated by parallel edges 15*d* and 15*e*. Each of the edges 15*a*, 15*b* and 15*c* are inclined or extend rearwardly towards the back end 11*b* of the body portion 11. As shown most clearly in FIGS. 2, 4 and 5, the first, second and third leading wing edges 15*a*, 15*b* and 15*c* are staged so that each wing edge progressively projects a greater distance radially laterally outward from the body portion 11. Referring to FIG. 10, the first, second and third leading wing edges 15*a*, 15*b* and 15*c* each take a successively larger bite out of the ground as the ground anchor 10 is driven into the ground 9. The smaller leading edges facilitate passage of the rearward and larger leading edges by reducing the amount of soil that the successive leading edges must plow through. Thereby, the total driving energy required for driving the wings 12 and ground anchor 10 through the ground is greatly reduced.

Figure 3:
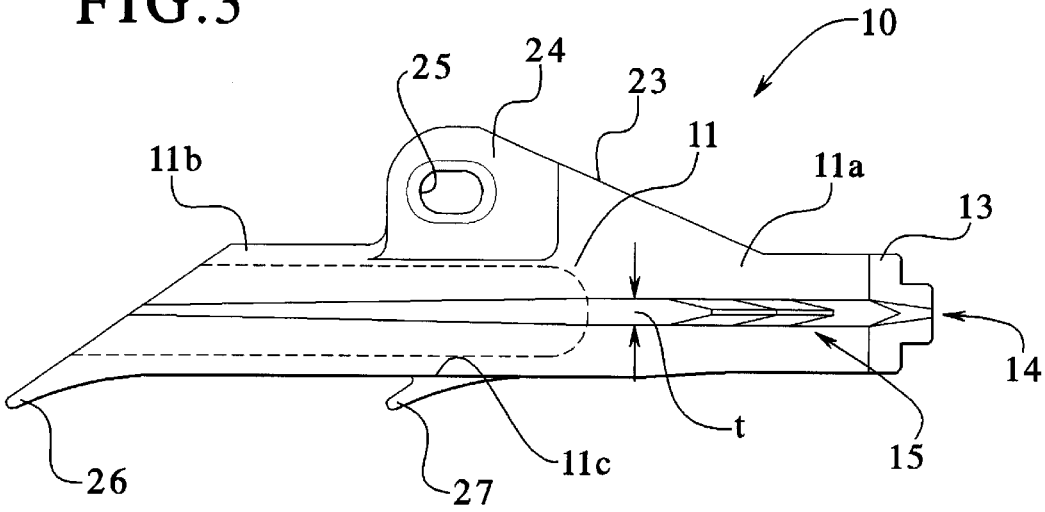
FIG. 3 is a side view of the anchor of FIGS. 1 and 2.
Figure 11:
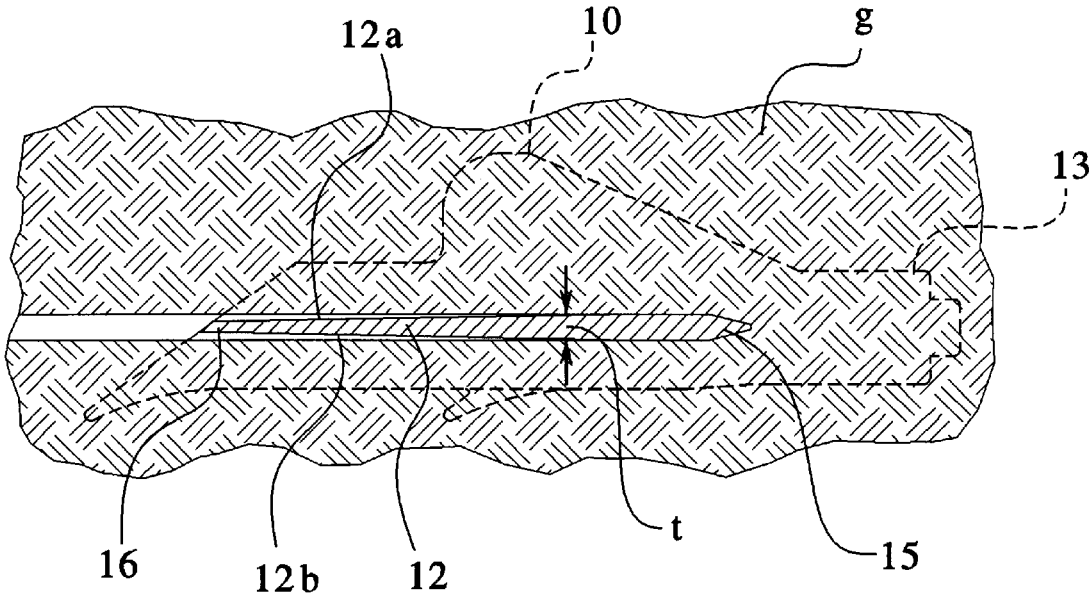
FIG. 11 is a side view of the ground anchor in the earth, illustrating passage of one of the wings through the ground.

To reduce friction between the wings 12 and the soil, the wings 12 preferably have a tapered cross-section so that the thickness t of the wings diminishes and tapers between the leading edges 15 and trailing edges 16 as most clearly shown in FIGS. 3 and 11. As an example, each of the wings 12 may have a thickness at the leading edges 15 of about ⅜ inch and have a thickness at the trailing edges 16 of about ¼ inch. Referring to FIG. 11, when anchor 10 is driven through the ground g, the thicker leading edges 15 of wings 12 plow away the soil and form an opening in the soil larger than the remaining thickness t of the wings 12. In that manner, the soil does not contact the entire surface area of the faces 12*a* and 12*b* of wings 12 as they pass through the soil, which greatly reduces the frictional contact between wings 12 and the soil. Thus, the total driving force required to drive anchor 10 into the ground is greatly reduced.

Figure 7:
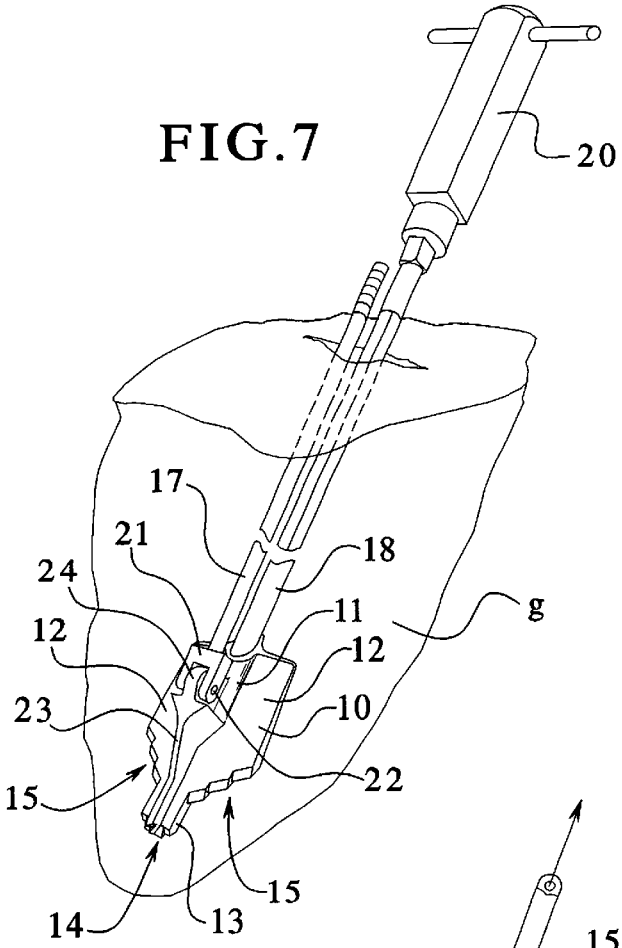
FIG. 7 is a front and side perspective view, with parts broken away, illustrating the manner in which the ground anchor is driven into the ground.
Figure 8:
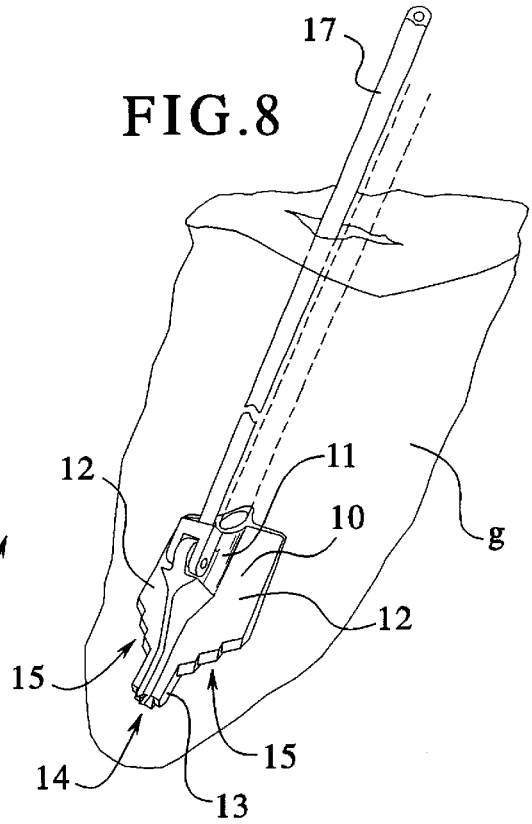
FIG. 8 is a view similar to FIG. 7, but illustrating the manner in which the pulling operation for setting the anchor is initiated.
Figure 9:
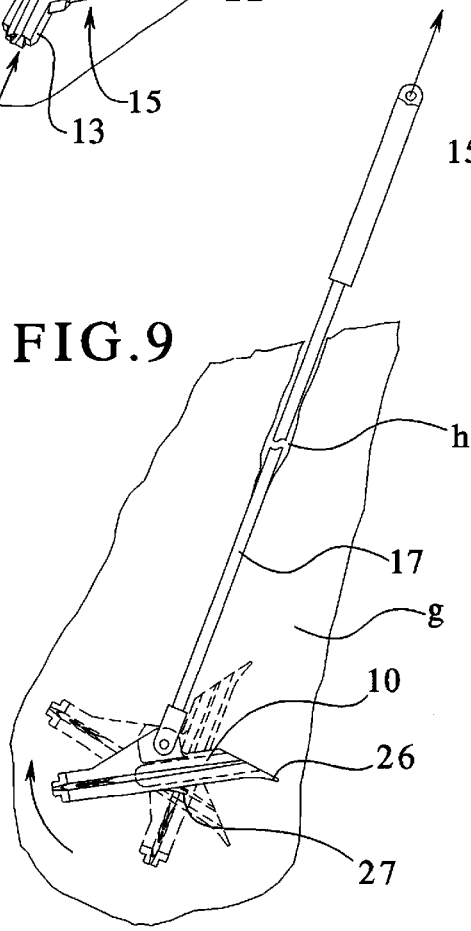
FIG. 9 is a view similar to FIG. 8, but taken 90° therefrom to illustrate the manner in which the anchor is tilted or rotated during the pulling operation.

Referring to FIGS. 7–9, ground anchor 10 may be positioned in the ground g in the same manner as described in co-owned U.S. Pat. No. 4,802,317, which is hereby incorporated by reference. Briefly, a pull member 17 is secured to the body portion 11 of ground anchor 10, and a drive rod 18 is inserted into a rounded opening 19 in the body portion 11. A jack hammer 20 or the like is connected to the other end of drive rod 18 for driving ground anchor 10 to an optimum depth within the ground. Once ground anchor 10 is positioned at its optimum depth, drive rod 18 is removed, as shown in FIG. 8. The operator then uses a pulling tool (not shown) to exert a force on pull member 17 until ground anchor 10 tilts to an orientation which is generally transverse to the length of the hole h as shown in FIG. 9.

As shown, the pull member 17 is secured to body portion 11 of the ground anchor by a U-shaped shackle 21 and a pivot pin 22. A raised longitudinal rib 24 diverges rearwardly from the leg portion 13 to the eye portion 23 for directing soil around shackle 21. For a more detailed description of the connection between the pull member 17 and ground anchor 10 and the rib 24, reference may be had to U.S. Pat. No. 4,802,317.

Figure 2:
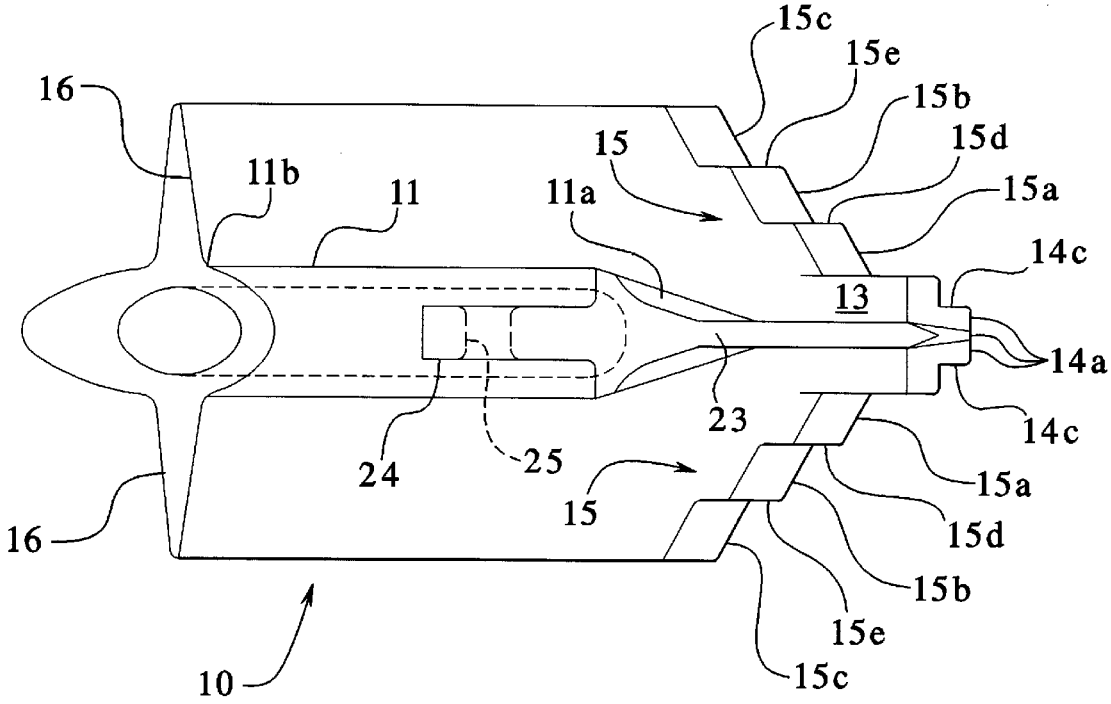
FIG. 2 is a top face view of the ground anchor of FIG. 1.

Referring to FIGS. 1–3, this invention represents an improvement over the structure disclosed in the U.S. Pat. No. 4,802,317 in that the eye portion 22 is provided with an elongated slot 25 for receiving pivot pin 22. The elongated slot 25 is sized to receive and allow longitudinal movement of the pivot pin 22 so that pull member 17 is longitudinally moveable with respect to ground anchor 10 during both the driving and pulling operations shown in FIGS. 7 and 9. Accordingly, impact loads between the pull member 17 and the ground anchor 10 are reduced by allowing them to move freely against each other and thus dissipating energy and impact forces as they work their way through the ground.

Referring to FIGS. 3 and 9, the back end 11*b* of body portion 11 includes a first curved lip portion 26 which extends transversely outward from the body portion 11 for facilitating rotation of the anchor in the ground. As shown in FIG. 9, the curved lip portion 26 bites into the ground when ground anchor 10 is tilted and provides a fulcrum for tilting ground anchor 10 into a transverse relation. To further facilitate tilting of the ground anchor, a mid-portion 11*c* of body portion 11 includes a second curved lip portion 27 which extends transversely outward from body portion 11. The first curved lip 26 extends transversely outward from the body portion 11 a greater distance than the second curved lip 27 which helps to advance the anchor through hard soils by advancing the smaller curved lip 27 first which allows for easier passage through the ground of the larger curved lip 26.

Preferably, the second curved lip 27 is provided at a section of the mid-portion 11*c* of body portion 11 which represents the widest profile of the entire ground anchor 10. As shown, that section is directly across from the eye portion 24 and the second curved lip 27 balances the profile of the ground anchor 10 to aid in maintaining a linear drive path through the ground even in the presence of de-stabilizing obstacles which might otherwise cause ground anchor 10 to follow an offset course.

While in the foregoing specification, embodiments of the present invention have been disclosed in considerable detail for the purposes of illustration, it will be understood by those skilled in the art that the details given herein may vary considerably within the spirit and scope of the invention.

We claim as our invention:

1. A ground anchor comprising:

a rigid plate member having a tubular longitudinal central body portion with a front and back end;

wings radiating laterally from the body portion along the length thereof; and a central axial leg portion projecting from the front end of the body portion forwardly of the wings and having radiating side edges, said side edges of said leg portion each having a plurality of sharpened leading side edges which are each longitudinally offset with respect to each other.

2. The ground anchor of claim 1 in which said plurality of sharpened leading side edges on each of said sides includes first and second longitudinally offset side edges which extend generally perpendicular to the body portion, said first and second side edges being longitudinally separated by a third side edge which extends generally parallel to the body portion.

3. The ground anchor of claim 2 in which said second side edge is positioned rearwardly of said first side edge and extends laterally outward from said body portion a greater distance than said first side edge.

4. The ground anchor of claim 1 in which the leading edges of the wings have a thickness which is greater than a thickness of trailing edges of the wings.

5. The ground anchor of claim 4 in which the thickness of the wings diminishes and tapers from the leading edges of the wings to the trailing edges of the wings.

6. The ground anchor of claim 1 in which said body portion has a raised longitudinal rib diverging rearwardly from the leg portion to an eye portion of the body portion, said eye portion including an elongated slot sized to receive and allow longitudinal movement of a pivot pin used to secure a pull member to the ground anchor.

7. The ground anchor of claim 6 in which a pull member is pivotally mounted to the eye portion and includes a U-shaped shackle with legs straddling the eye portion, and a pivot pin extends through the elongated slot of the eye portion and is secured to the legs of the shackle, whereby, the pivot pin is longitudinally movable within said elongated slot so that said pull member is longitudinally moveable with respect to the ground anchor.

8. The ground anchor of claim 1 in which said wings each having a plurality of sharpened leading wing edges which are each longitudinally offset with respect to each other, said plurality of leading wing edges includes first, second and third longitudinally offset wing edges which are longitudinally separated by wing edges generally parallel to the body portion.

9. The ground anchor of claim 8 in which said first, second and third wing edges on each of said wings are angled rearwardly towards the back end of the body portion.

10. The ground anchor of claim 8 in which said third wing edge is positioned rearwardly of said first and second wing edges and extends laterally outward from said body portion a greater distance than said first and second wing edges, and said second wing edge is positioned rearwardly of said first wing edge and extends laterally outward from said body portion a greater distance than said first wing edge.

11. The ground anchor of claim 1 in which said back end of said body portion includes a first curved lip which extends transversely outward from the body portion for facilitating rotation of the anchor in the ground and a mid-portion of the body portion includes a second curved lip which extends transversely outward from the body portion for facilitating rotation of the anchor in the ground.

12. The ground anchor of claim 11 in which the body portion includes a maximum profile and said second curved lip is positioned at said maximum profile of said body portion.

13. The ground anchor of claim 11 in which said first curved lip projects transversely outward from the body portion a distance greater than said second curved lip.

14. A ground anchor comprising:

a rigid plate member having a longitudinal central body portion with front and back ends;

a pair of wings extending laterally from the body portion in opposite directions and having leading edges and trailing edges, each of said wings having a thickness which diminishes and tapers between the leading and trailing edges; and a central axial leg portion projecting from the front end of the body portion and including radiating side edges adapted for piercing the ground.

15. The ground anchor of claim 14 in which the side edges of the leg portion each include first and second, longitudinally offset, sharped leading side edges extending transversely to the body portion, said second side edge being positioned rearwardly of said first side edge and extending laterally outward from the leg portion a greater distance than said first side edge.

16. The ground anchor of claim 14 in which the leading edges of each of the wings include first, second and third longitudinally offset wing edges which are angled rearwardly towards the back end of the body portion, said third wing edge being positioned rearwardly of said first and second wing edges and extending laterally outward from the body portion a greater distance than said first and second wing edges, and said second wing edge being positioned rearwardly of said first wing edge and extending laterally outward from the body portion a greater distance than said first wing edge.

17. The ground anchor of claim 14 in which said body portion includes an eye portion having an elongated slot sized to receive and allow longitudinal movement of a pivot pin used to secure a pull member to ground anchor, whereby said pull member is longitudinally moveable with respect to the ground anchor.

18. The ground anchor of claim 14 in which the back end of the body portion includes a first curved lip which extends transversely outward from the body portion for facilitating rotation of the anchor in the ground and a mid-portion of the body portion includes a second curved lip which extends transversely outward from the body portion for facilitating rotation of the anchor in the ground, said second curved lip being positioned generally at the widest portion of the ground anchor.

19. The ground anchor of claim 18 in which said first curved lip projects transversely outward from the body portion a greater distance than said second curved lip.

20. A ground anchor comprising:

a rigid plate member having a tubular longitudinal central body portion with a front and back end;

wings radiating laterally from the body portion along the length thereof;

a central leg portion projecting from the front end of the body portion forwardly of the wings and including radiating side edges adapted for piercing the ground;

a first curved lip portion extending from the back end of the body portion for facilitating rotation of the anchor in the ground; and a second curved lip portion extending transversely outward from the body portion and being positioned forwardly of the first curved lip portion for further facilitating rotation of the anchor in the ground, said first and second curved lips being positioned along a bottom face of the body portion and said first curved lip portion extending transversely outward from the body portion a greater distance than said second curved lip.

21. The ground anchor of claim 20 in which the side edges of the leg portion each include first and second longitudinally offset sharped leading side edges extending transversely to the body portion, said second side edge being positioned rearwardly of said first side edge and extending laterally outward from the leg portion a greater distance than said first side edge.

22. The ground anchor of claim 20 in which the leading edges of each of the wings include first, second and third longitudinally offset wing edges which are angled rearwardly towards the back end of the body portion, said third wing edge being positioned rearwardly of said first and second wing edges and extending laterally outward from the body portion a greater distance than said first and second wing edges, and said second wing edge being positioned rearwardly of said first wing edge and extending laterally outward from the body portion a greater distance than said first wing edge.

23. A ground anchor comprising:

a rigid plate member having a tubular longitudinal central body portion with a front and back end;

wings radiating laterally from the body portion along the length thereof, said wings each having a plurality of sharpened leading wing edges which are each longitudinally offset with respect to each other; and a central axial leg portion projecting from the front end of the body portion forwardly of the wings and having radiating side edges, said plurality of leading wing edges including first, second and third longitudinally offset wing edges which are each longitudinally separated by wing edges generally parallel to the body portion.

24. The ground anchor of claim 23 in which said first, second and third wing edges on each of said wings are angled rearwardly towards the back end of the body portion.

25. The ground anchor of claim 23 in which said third wing edge is positioned rearwardly of said first and second wing edges and extends laterally outward from said body portion a greater distance than said first and second wing edges, and said second wing edge is positioned rearwardly of said first wing edge and extends laterally outward from said body portion a greater distance than said first wing edge.

26. The ground anchor of claim 23 in which said side edges of said leg portion each having a plurality of sharpened leading side edges which are each longitudinally offset with respect to each other, and said plurality of sharpened leading side edges on each of said sides includes first and second longitudinally offset side edges which extend generally perpendicular to the body portion, said first and second side edges being longitudinally separated by a third side edge which extends generally parallel to the body portion.

27. The ground anchor of claim 26 in which said second side edge is positioned rearwardly of said first side edge and extends laterally outward from said body portion a greater distance than said first side edge.

28. The ground anchor of claim 23 in which the leading edges of the wings have a thickness which is greater than a thickness of trailing edges of the wings.

29. The ground anchor of claim 28 in which the thickness of the wings diminishes and tapers from the leading edges of the wings to the trailing edges of the wings.

30. The ground anchor of claim 23 in which said body portion has a raised longitudinal rib diverging rearwardly from the leg portion to an eye portion of the body portion, said eye portion including an elongated slot sized to receive and allow longitudinal movement of a pivot pin used to secure a pull member to the ground anchor.

31. The ground anchor of claim 30 in which a pull member is pivotally mounted to the eye portion and includes a U-shaped shackle with legs straddling the eye portion, and a pivot pin extends through the elongated slot of the eye portion and is secured to the legs of the shackle, whereby, the pivot pin is longitudinally movable within said elongated slot so that said pull member is longitudinally moveable with respect to the ground anchor.

32. The ground anchor of claim 23 in which said back end of said body portion includes a first curved lip which extends transversely outward from the body portion for facilitating rotation of the anchor in the ground and a mid-portion of the body portion includes a second curved lip which extends transversely outward from the body portion for facilitating rotation of the anchor in the ground.

33. The ground anchor of claim 32 in which the body portion includes a maximum profile and said second curved lip is positioned at said maximum profile of said body portion.

34. The ground anchor of claim 32 in which said first curved lip projects transversely outward from the body portion a distance greater than said second curved lip.

35. A ground anchor comprising:

a rigid plate member having a tubular longitudinal central body portion with a front end and a back end;

a pair of wings radiating laterally from the body portion and having front edges;

first, second and third sharpened leading edges which extend along said front edges of each of said wings and which are each longitudinally offset with respect to each other, each of said first, second and third sharpened leading edges having respectively a first, second and third tapered portion with a front edge and a back edge integral with said wing, said front of said first tapered portion being positioned forwardly of said back edge of said second tapered portion and said front of said second tapered portion being positioned forwardly of said back edge of said third tapered portion; and a central axial leg portion projecting from the front end of the body portion forwardly of the wings and having radiating side edges.

* * * * *